United States Patent [19]

Spreter von Kreudenstein

[11] 4,192,148

[45] Mar. 11, 1980

[54] DEVICE TO CREATE COOLING THROUGH USE OF WASTE HEAT

[76] Inventor: Emil H. Spreter von Kreudenstein, 3 Am Kreuzweg, 8026 Ebenhausen, Fed. Rep. of Germany

[21] Appl. No.: 915,297

[22] Filed: Jun. 13, 1978

[30] Foreign Application Priority Data

Dec. 8, 1977 [DE] Fed. Rep. of Germany ..... 2754783

[51] Int. Cl.[2] ..... F25B 1/00; F25B 1/06

[52] U.S. Cl. ..... 62/116; 62/500

[58] Field of Search ..... 62/116, 500, 501

[56] References Cited

U.S. PATENT DOCUMENTS

| | | | |
|---|---|---|---|
| 2,763,998 | 9/1956 | Tulleners | 62/500 |
| 3,199,310 | 8/1965 | Schlichtig | 62/500 |
| 3,277,659 | 10/1966 | Sylvan et al. | 62/500 |
| 3,277,660 | 10/1966 | Kemper et al. | 62/116 |
| 3,402,570 | 9/1968 | Schlichtig | 62/500 |
| 3,701,264 | 10/1972 | Newton | 62/500 |
| 4,007,776 | 2/1977 | Alkasab | 62/500 |
| 4,023,948 | 5/1977 | Pitts et al. | 62/500 |

*Primary Examiner*—Lloyd L. King

*Attorney, Agent, or Firm*—Clarence A. O'Brien; Harvey B. Jacobson

[57] ABSTRACT

The invention relates to apparatus and a method for production of cold by the use of waste heat, more particularly to production of cold with use of refrigerating equipment with a steam jet apparatus which operates with a one-component refrigerant.

7 Claims, 5 Drawing Figures

DEVICE TO CREATE COOLING THROUGH USE OF WASTE HEAT

BACKGROUND OF THE INVENTION

1. Field of the Invention

The invention relates to apparatus and a method for production of cold by the use of waste heat, more particularly to production of cold with use of refrigerating equipment with a steam jet apparatus which operates with a one-component refrigerant.

2. Description of the Prior Art

In industry, as well as in the case of other heat processes, often large quantities of heated materials are obtained which in most cases are not used but are discharged to the environment by cooling. A suitable method for the use of such quantities of heat is the operation of refrigerating equipment. For this in principle, both two-component refrigerating equipment (for example, ammonia and water) as well as refrigerating equipment with single component refrigerants come into question. Both the known systems with two-component refrigerants as well as the systems with one-component refrigerants have, however, the disadvantage that in addition to the energy present in the form of waste heat, mechanical or electric power is needed for the circulation of the refrigerant or for again raising the pressure of the refrigerant.

It has also been known to use refrigerating equipment with jet compressors for the use of waste heat, which equipment operates with organic refrigerants and is capable of using heat sources, the temperatures of which lie up to 80 degrees C. Reasons for the creation of such refrigerating equipment are the low costs for heat and the simple construction (see, for example, the journal "Kaltetechnik-Klimatisierung" [refrigerating technique-refrigeration] No. 3/1971, a report concerning investigations of such refrigerating equipment with jet compressors). But even these per se advantageous refrigeration machines with jet compressors have the disadvantage of needing, beside the waste heat, in addition electric power for pumps.

Other related apparatus for producing cold is disclosed in German Offenlegungsschrift 23 36 864, filed July 19, 1973, and laid open for public inspection Feb. 6, 1975, and by German Offenlegungsschrift 23 11 901, filed Mar. 9, 1973, and laid open for public inspection Sept. 12, 1974.

Starting out from these known refrigerating machines with steam jet compression, an arrangement for the production of cold with the use of waste heat became known which uses for the operation of the entire refrigerating machine only the power supplied to the refrigerant in the form of heat.

SUMMARY OF THE INVENTION

The present invention is based on the task of creating a particularly advantageous arrangement of this type constructing it on this principle. According to the invention, this task is solved using a heat exchanger for the supply of the waste heat to the refrigerant, a liquid jet apparatus, a cooler for cooling the refrigerant, a throttle valve for expanding and cooling the refrigerant by a steam pump for sucking off the refrigerant from the liquid jet apparatus which is disposed at such a level above the level of the liquid in the heat exchanger, so that the operating capacity of the refrigerant steam suffices for forcing the refrigerant sucked into the Venturi tube of the steam pump into the heat exchanger and a double acting valve closing alternatingly and disposed in the direction of flow of the refrigerant steam in front of the steam pump, which double acting valve feeds the high pressure refrigerant steam rhythmically interrupted.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
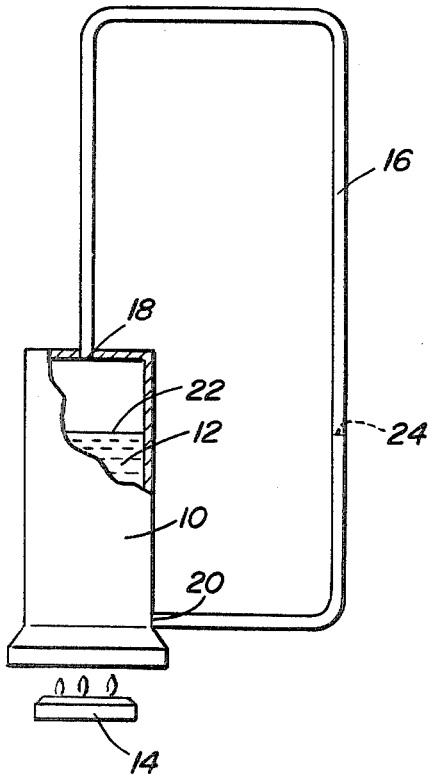
FIG. 1 is a partly sectional schematic view of apparatus depicted to illustrate principles of the present invention.

FIG. 1 shows a tank 10 containing refrigerant such as water 12 heated by heater 14. Line 16 communicates between opening 18 at the top of tank 10 and opening 20 near the bottom of tank 10, and below liquid level 22 in tank 10. Openings 18 and 20 permit free flow of fluid and steam, and liquid in line 16 rises to line liquid level 24.

Figure 2:
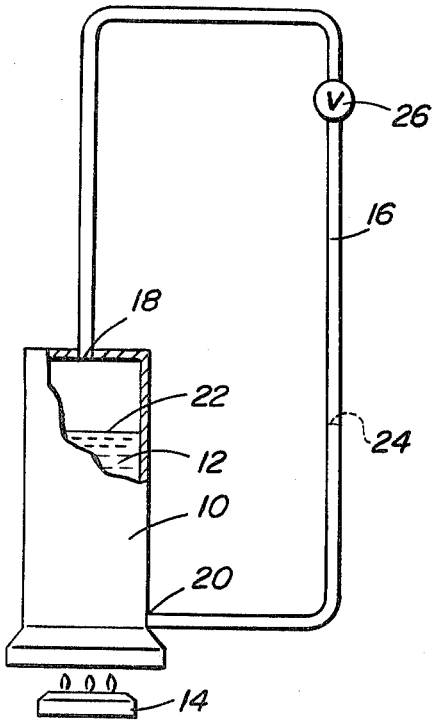
FIG. 2 is a partly sectional schematic view of apparatus used to illustrate principles of the present invention.

FIG. 2 shows the same elements as FIG. 1, together with valve 26, inserted in line 16 above line liquid level 24. Heating of liquid 12 in tank 10 through heater 14 in FIG. 2 now causes liquid in line 16 to rise above level 24 to the level of valve 26. Whenever valve 26 is opened, the liquid drops in line 16 and oscillates about line liquid level 24. When valve 26 is closed again, the liquid again rises, due to condensation of vapor up to valve 26.

Figure 3:
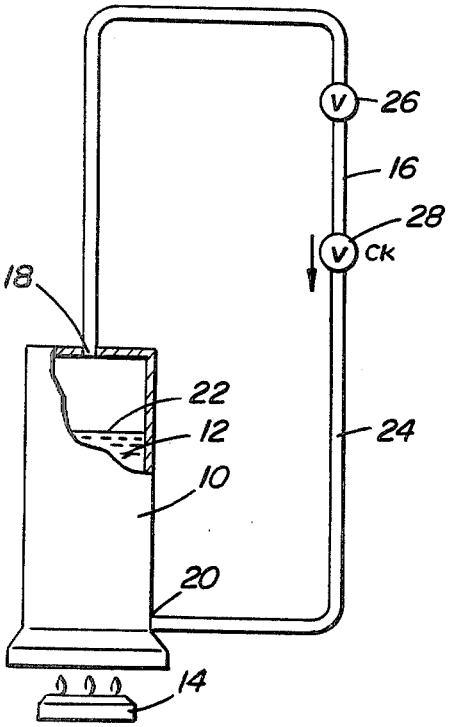
FIG. 3 is a partly sectional schematic view of apparatus used to illustrate principles of the present invention.

FIG. 3 shows the same elements as FIG. 2, together with check valve 28 which permits liquid flow only in the downward direction after valve 28 is closed. Heating of liquid 12 in tank 10 by heater 14 if valve 26 is being closed now permits liquid in line 16, when check valve 28 is closed, to rise the level of check valve 28. With closed check valve 28, steam within line 16 between valve 26 and check valve 28 condenses, as a result of which a vacuum develops in the line between valve 26 and check valve 28.

Figure 4:
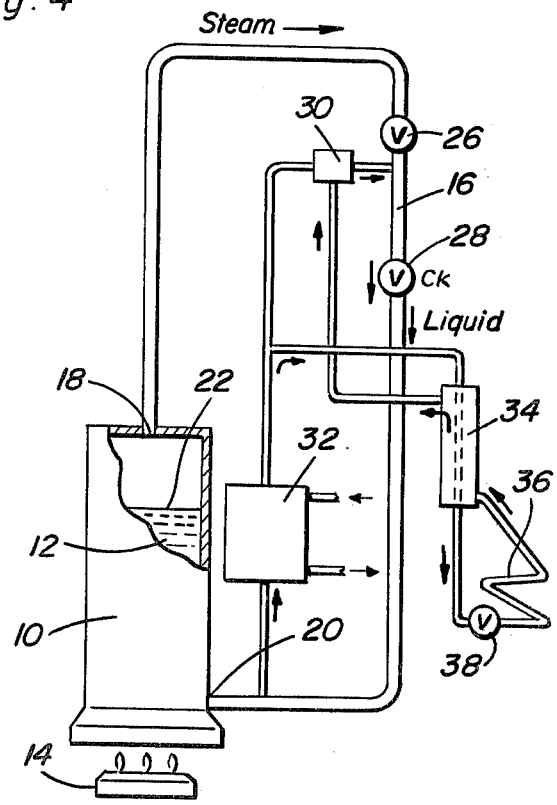
FIG. 4 is a partly sectional schematic view of apparatus used to illustrate principles of the present invention.

FIG. 4 shows the same elements as FIG. 3, together with jet apparatus 30, cooler 32, countercurrent heat exchanger 34, evaporator 36 and throttle valve 38. Heating of liquid 12 in tank 10 forces liquid to rise in line 16 to the level of check valve 28, as in FIG. 3, and valve 26 is closed. As a result of the vacuum in line 16 between check valve 28 and valve 26, liquid from jet pump 30 is sucked in from the jet pump and, upon reopening of valve 26, is conveyed into the boiler. If valve 26 is closed again, operation is repeated. Heat is exchanged through cooler 32 and evaporator 36 on the outside.

The discussion of FIGS. 1, 2, 3, and 4 above is intended only to exemplify principles and clarify operation of the present invention. The embodiment of the present invention disclosed and claimed is illustrated by FIG. 5, discussed hereinbelow.

Figure 5:
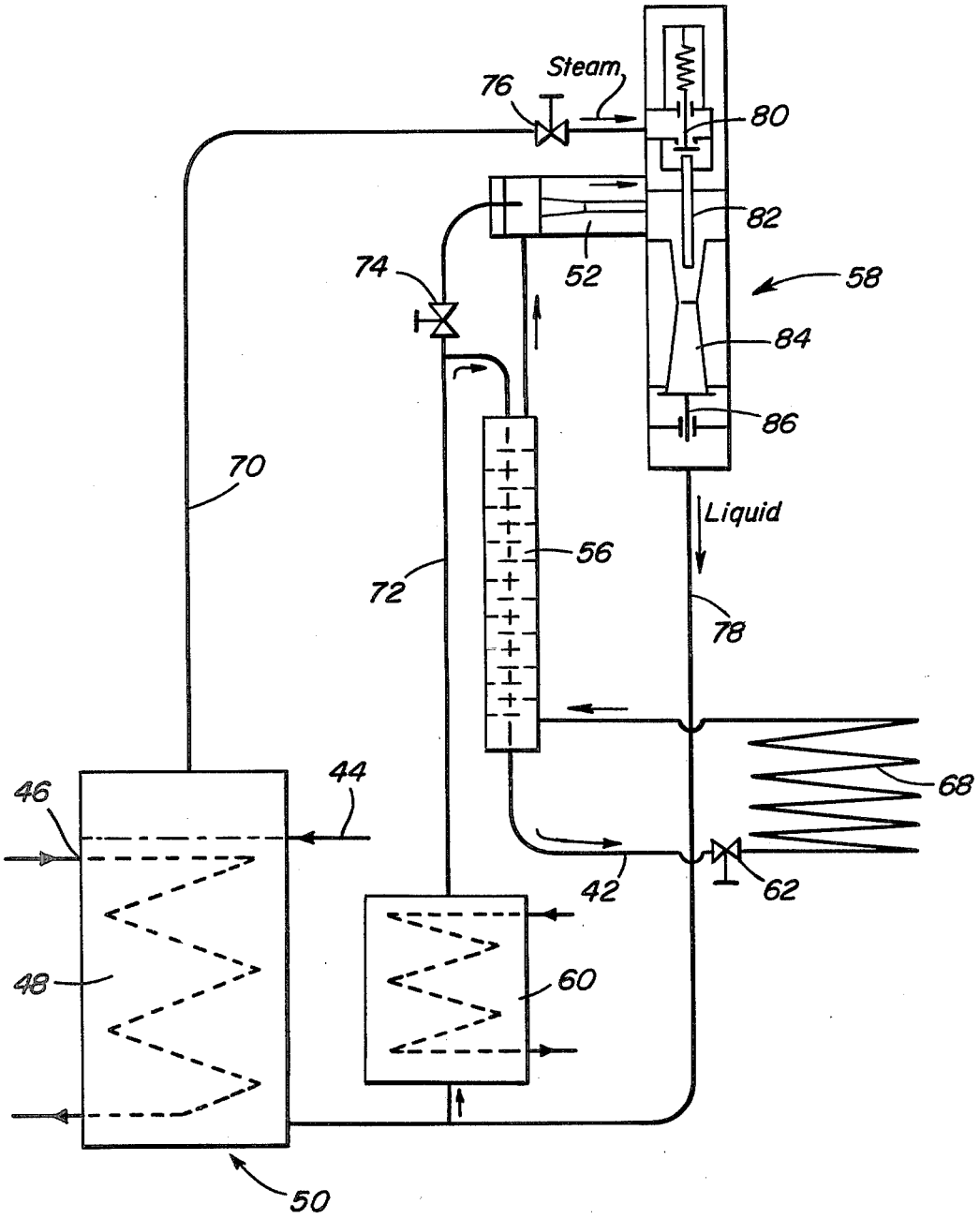
FIG. 5 is a schematic view of the apparatus of the present invention.

In the arrangement shown in FIG. 5, the number 50 designates a heat exchanger which feeds the heat to liquid refrigerant 48 into heat exchanger 50 through inlet 46, 52 designates a liquid jet pump (ejector) for sucking off the refrigerant steam from a countercurrent heat exchanger 56, 58 is a steam pump, 60 a cooler, 62 a throttle valve, 68 designates the evaporator, 70 a steam line, 72 a liquid line, valves 74 and 76 are locking elements, 78 is the return line from steam pump 58 to cooler 60 and heat exchanger 50. The arrangement operates as follows. In heat exchanger 50, a high pressure refrigerant steam is produced by the heat fed in through inlet 46 which steam is fed via line 70 to steam pump 58. Pump 58 sucks in liquid from liquid jet pump 52 and conveys it again via line 78 under pressure into the heat exchanger 50. Liquid jet pump 52 is fed via cooler 60 and line 72 with cold refrigerant being under pressure and it sucks in evaporated refrigerant from countercurrent heat exchanger 56. Throttle valve 62 is likewise supplied via cooler 60 and line 72 with cold refrigerant under pressure, which then evaporates in evaporator 68 while absorbing heat. Valves 74 and 76 only serve as locking elements and have nothing to do per se with the functioning of the arrangement.

Whenever one compares the heat of vaporization of, for example, "Frigen" (Freon) 11, of about 40 kcal/kg with the heat of vaporization of water ($H_2O$) of approximately 650 kcal/kg, then one will recognize that the operating output of refrigerant steam alone will not suffice to convey liquid refrigerant directly counter to the pressure in heat exchanger, into said heat exchanger 50. With the arrangement according to the invention, the feeding in of refrigerant into heat exchanger 50 will be achieved by the special arrangement of a steam pump. Steam pump 58 is a combination of injector and pulsometer. It consists essentially of a spring-loaded double acting valve 80, a steam nozzle 82, a Venturi tube 84 and a non-return check valve 86. It operates as follows:

Steam pump 58, according to the law of communicating pipes, is disposed so high above the level of the liquid 44 of heat exchange 50 that the operating capacity of the refrigerant steam will suffice in order to press the cold refrigerant sucked into Venturi tube 84 into heat exchanger 50. As a result of spring-loaded double acting valve 80, the supply of steam to Venturi tube 84 is interrupted at that moment in which the liquid sucked in has been ejected from Venturi tube 84 via check valve 86 into return line 78. Check valve 86 closes and the steam still present condenses, as a result of which an underpressure develops in Venturi tube 84 through which new refrigerant is sucked in. After filling Venturi tube 84, steam valve 80 opens again and the new operating cycle starts.

Naturally, it is possible in order to achieve an approximately uniform conveyance of the refrigerant and contemplated within the scope of the invention to provide two or more steam pumps which are displaced in their operating cycle in the arrangement according to the invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. Apparatus for cooling an input liquid by waste heat comprising heat exchange means for receiving said waste heat and vaporizing a refrigerant, valve means connected to the heat exchange means, and cooling means for removing heat from an input liquid, said valve means interruptedly circulating said refrigerant from the valve means through a return line to said cooling means and thence back to said valve means, said refrigerant being vaporized in said heat exchange means, interruptedly condensed in said valve means and intermittently discharged into said return line, a portion of said refrigerant in said return line being returned to said heat exchange means, wherein said valve means comprises a steam valve, a Venturi tube, a liquid jet pump, and a check valve, said steam valve being spring loaded for introducing pressurized vaporized refrigerant from said heat exchange means into said Venturi tube, said liquid jet pump being connected to said return line for introducing into said Venturi tube refrigerant returned from said cooling means to said valve means, said check valve connecting said Venturi tube with said return line and permitting said refrigerant to flow only in the direction from said Venturi tube to said return line, said valve means being located at a height above said heat exchange means.

2. The apparatus of claim 1 together with heat removal means for removing heat from a second input liquid, said heat removal means comprising an evaporator and an associated throttle valve, said throttle valve being adapted to receive refrigerant between said cooler and said valve means through an evaporator inlet line, said evaporator being adapted to discharge refrigerant to said valve means through an evaporator outlet line.

3. The apparatus of claim 2 wherein said evaporator inlet line is in heat exchange relation with said evaporator outlet line.

4. The apparatus of claim 3 wherein said refrigerant is a liquid and said vaporized refrigerant is the vapor of said liquid.

5. A method of operating apparatus for cooling an input liquid by waste heat comprising heat exchange means for receiving said waste heat and vaporizing a refrigerant, valve means comprising a steam valve, a Venturi tube a liquid jet pump, and a check valve, and cooling means for removing heat from an input liquid, said valve means interruptedly circulating said refrigerant from the valve means through a return line to said cooling means and thence back to said valve means, said refrigerant being vaporized in said heat exchange means, interruptedly condensed in said valve means and intermittently discharged into said return line, a portion of said refrigerant in said return line being returned to said heat exchange means, said steam valve being spring loaded for introducing pressurized vaporized refrigerant from said heat exchange means into said Venturi tube, said liquid jet pump being connected to said return line for introducing into said Venturi tube refrigerant returned from said cooling means to said valve means, said check valve connecting said Venturi tube with said return line and permitting said refrigerant to flow only in the direction from said Venturi tube to said return line, said valve being located at a height above said heat exchange means, wherein heat removal means is provided for removing heat from a second input liquid, said heat removal means comprising an evaporator and an associated throttle valve, said throttle valve being adapted to receive refrigerant between said cooler and said valve means through an evaporator inlet line, said evaporator being adapted to discharge refrigerant to said valve means through an evaporator outlet line, the method comprising the steps of:

(a) introducing an input fluid containing waste heat into said heat exchange means, said input fluid having a temperature sufficiently high to vaporize and pressurize said refrigerant;

(b) withdrawing said input fluid from said heat exchanger;

(c) introducing a cooling fluid in heat exchange relationship with refrigerant in said cooler;

(d) withdrawing said cooling fluid;

(e) introducing an evaporator fluid in heat exchange relationship with refrigerant in said evaporator; and (f) withdrawing said evaporator fluid.

6. Apparatus for the production of cold by the use of waste heat comprising a heat exchanger for introducing waste heat to a liquid refrigerant and vaporizing said liquid refrigerant, a steam line for conveying vapor from said heat exchanger to a steam pump, a return line for conveying liquid refrigerant exiting the steam pump to said heat exchanger, a liquid jet pump attached to said steam pump and furnishing liquid refrigerant to said steam pump from said return line, cooling means for removing heat from liquid refrigerant furnished said liquid jet pump, wherein said cooling means comprises in parallel arrangement a cooler and a refrigerating means, said cooler being in heat exchange relationship with said refrigerant passing from said return line to said jet pump, and said refrigerating means comprising a countercurrent heat exchanger, a throttle valve, and an evaporator, vaporized refrigerant produced in said evaporator being in countercurrent heat exchange relationship with liquid refrigerant entering said evaporator, said steam pump comprising a spring-loaded double acting valve adapted to receive vaporized refrigerant from said steam line, a steam nozzle receiving vaporized refrigerant from the steam valve, a Venturi tube adapted to receive vaporized refrigerant from said steam nozzle and liquid refrigerant from said jet pump, and a check valve between the Venturi tube and return line, adapted to permit flow of liquid only in the direction of said Venturi tube to said return line.

7. The apparatus of claim 4 wherein said liquid is water.

* * * * *